US007955119B2

(12) United States Patent
Li et al.

(10) Patent No.: US 7,955,119 B2
(45) Date of Patent: Jun. 7, 2011

(54) LAMP ASSEMBLY HAVING SELF-RETAINING MEANS

(75) Inventors: Xiao-Li Li, Kunshan (CN); Ping-Sheng Su, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 318 days.

(21) Appl. No.: 12/286,311

(22) Filed: Sep. 29, 2008

(65) Prior Publication Data

US 2009/0086510 A1 Apr. 2, 2009

(30) Foreign Application Priority Data

Sep. 29, 2007 (CN) ..... 2007 2 0044335 U

(51) Int. Cl.
*H01R 13/58* (2006.01)

(52) U.S. Cl. ..... 439/460; 439/617

(58) Field of Classification Search ..... 439/417, 439/602, 617, 619, 460, 356, 419, 699.2
See application file for complete search history.

(56) References Cited

U.S. PATENT DOCUMENTS 5,580,159 A * 12/1996 Liu ..... 362/657
5,681,107 A * 10/1997 Wang ..... 362/249.01
5,718,502 A 2/1998 Tseng
5,989,047 A * 11/1999 Huang ..... 439/252
6,183,310 B1 * 2/2001 Shu ..... 439/699.2

FOREIGN PATENT DOCUMENTS

CN 2392977 8/2000

* cited by examiner

*Primary Examiner* — Edwin A. Leon
(74) *Attorney, Agent, or Firm* — Wei Te Chung; Andrew C. Cheng; Ming Chieh Chang

(57) ABSTRACT

A lamp assembly (100) includes a lamp base (3) defining a socket, with a mounting portion (33) arranged therein; a pair of cables (4) inserted into the socket via a cable passage defined in a rear portion of the lamp base, with conductors of the cables extending through passageways in the mounting portion and configured to hook thereon; a lamp holder (2) having a body portion inserted into the socket of the lamp base together with the mounting portion to sandwich the conductors; and a lamp bulb (1) held by the lamp holder, with a pair of legs thereof inserted into the socket and contacting conductors of the cables.

20 Claims, 7 Drawing Sheets

LAMP ASSEMBLY HAVING SELF-RETAINING MEANS

FIELD OF THE INVENTION

The present invention generally relates to a lamp assembly, and more particularly to a LED (light emitting diode) lamp assembly which has wires securely attached to a lamp base by self-retaining means, without additional auxiliary devices.

DESCRIPTION OF PRIOR ART

In Christmas or other celebrated Festivals, lamp assemblies are widely used for decoration so as to create amicable atmosphere. The previous (and existing) lamp assembly mainly uses incandescent lamp, which consumes great power energy. LED lamp is newly emerged high effective illuminate device, having some advantages, such as lower profile, little energy consumption and long life span, etc.

CN Pat. No. 2392977 issued on Aug. 23, 2000 to Tseng discloses a decorative lamp for festive occasions. The decorative lamp includes a lamp bulb, a lamp holder, a lamp base, two wires and two slim metal sheets. The lamp bulb is retained with the lamp holder, with pair of electrodes thereof extending through an peripheral portion of the lamp holder and accessible from outside. The lamp base defines a hollow portion therein, and the slim metal sheets are coupled to the two wires and securely attached to an inside wall of the lamp base. The lamp bulb together with the lamp holder are assembled to the lamp base, with the pair of electrodes contacting the pair of conductive pads, respectively. However, as the aforementioned lamp is relative complicated and laborious, which may not be manufactured easily and further increase cost.

Hence, an improved lamp assembly is highly desired to overcome the aforementioned problems.

SUMMARY OF THE INVENTION

Accordingly, an object of the present invention is to provide a lamp assembly which may be manufactured easily and lower cost.

In order to achieve the object set forth, a lamp assembly in accordance with the present invention comprises a lamp base defining a socket, with a mounting portion arranged therein; a pair of cables inserted into the socket via a cable passage defined in a rear portion of the lamp base, with conductors of the cables extending through passageways in the mounting portion and configured to hook thereon; a lamp holder having a body portion inserted into the socket of the lamp base together with the mounting portion to sandwich the conductors; and a lamp bulb held by the lamp holder, with a pair of legs thereof inserted into the socket and contacting conductors of the cables.

Other objects, advantages and novel features of the invention will become more apparent from the following detailed description when taken in conjunction with the accompanying drawings.

DETAILED DESCRIPTION OF PREFERRED EMBODIMENTS

Figure 1:
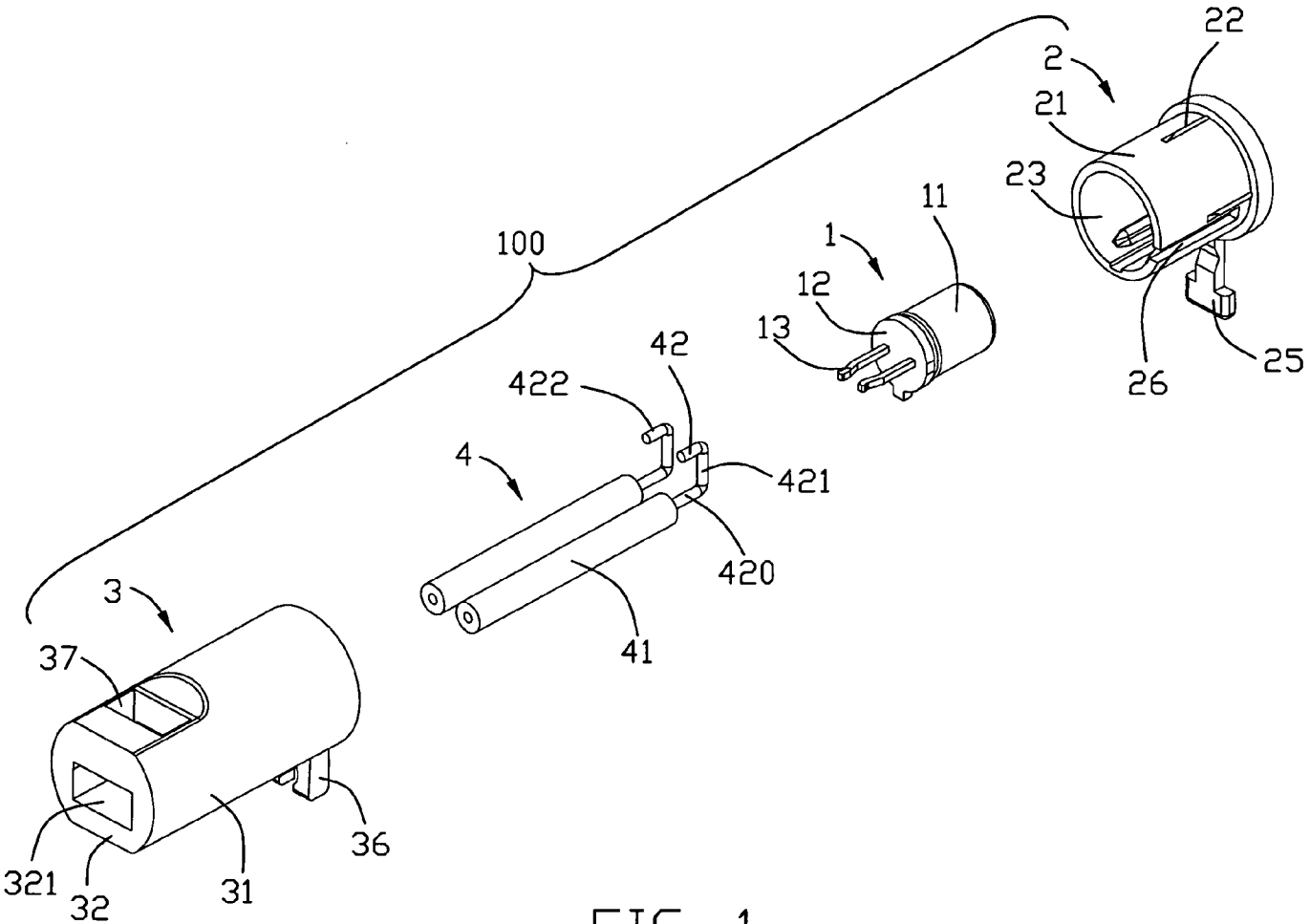
FIG. 1 is an exploded, perspective view of a lamp assembly in accordance with the present invention.
Figure 2:
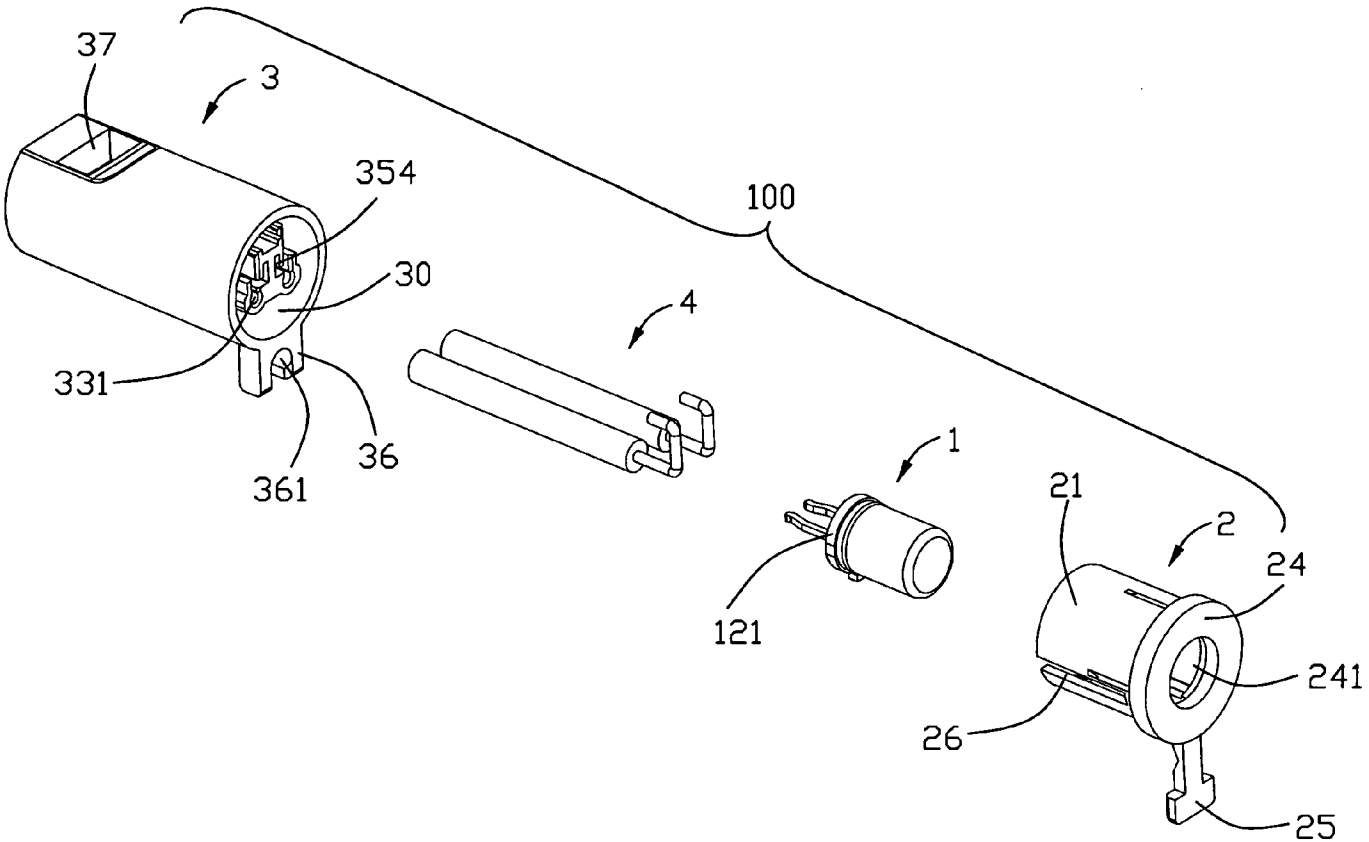
FIG. 2 is similar to FIG. 1, but viewed from another aspect.

Reference will now be made in detail to the preferred embodiment of the present invention.

Referring to FIGS. 1-7, a lamp assembly 100 in accordance with the present invention comprises a lamp bulb 1, a lamp holder 2, a lamp base 3 and a pair of cables 4.

The lamp bulb 1 utilizes LED (Light Emitting Diode) as light source, but other light source, such as incandescence light is available. The lamp bulb 1 includes a lens body 11 with a LED chip (not shown) therein, a substrate 12 for supporting the lens body 11, and a pair of legs 13 connecting the lens body 11 and extending outside through the substrate 12.

The lamp holder 2 has body portion 21 enclosing a hollow portion 23 therein and a lid 24 formed at a front end of the body portion 21. The body portion 21 is circular-shaped view along front-to-back direction, however, in alternative embodiments, other different shapes, such as rectangular shape, elliptic shape, etc. is available. A number of ribs 22 are formed on a peripheral portion of the body portion 21 and extend along an axial direction. A lengthwise slot 26 is defined in the body portion 21 and further communicate with the hollow portion 23. The lid 24 further defines an outlet 241 in a central portion thereof. The outlet 241 has substantially same cross-section as that of the lens 11, thus, the LED lamp 1 is retained in the hollow portion 23 of the lamp holder 2, with the lens 11 of the LED lamp 1 protruding outside through the outlet 241 of the lid 24. A T-shaped clasp 25 is equipped at a lateral side of the lid 24. A number of protruding portions 27 are formed on an inner surface of the body portion 21 and extend along the axial direction.

The lamp base 3 includes a cylindrical peripheral wall 31 and rear wall 32 connecting to the peripheral wall 31 to define a socket 30 with a front opening (not numbered). A cable passage 321 is recessed inwardly from an outer surface of the rear wall 32 and communicates with the socket 30. A first post 35 and a second post 350 are disposed opposite to one another and extend forwardly from an inner surface of the rear wall 32. The first post 35 is connected to an inner surface of the cylindrical peripheral wall 31, with the second post 350 is discrete from the inner surface of the cylindrical peripheral wall 31. When the lamp holder 2 is inserted into the socket 30 of the lamp base 3, the first post 35 slides along the slot 26 of the body portion 21, until they are fully mated, while the second post 350 relies against an inner surface of the lamp holder 2, and such configuration may achieve anti-mismating effect.

Figure 3:
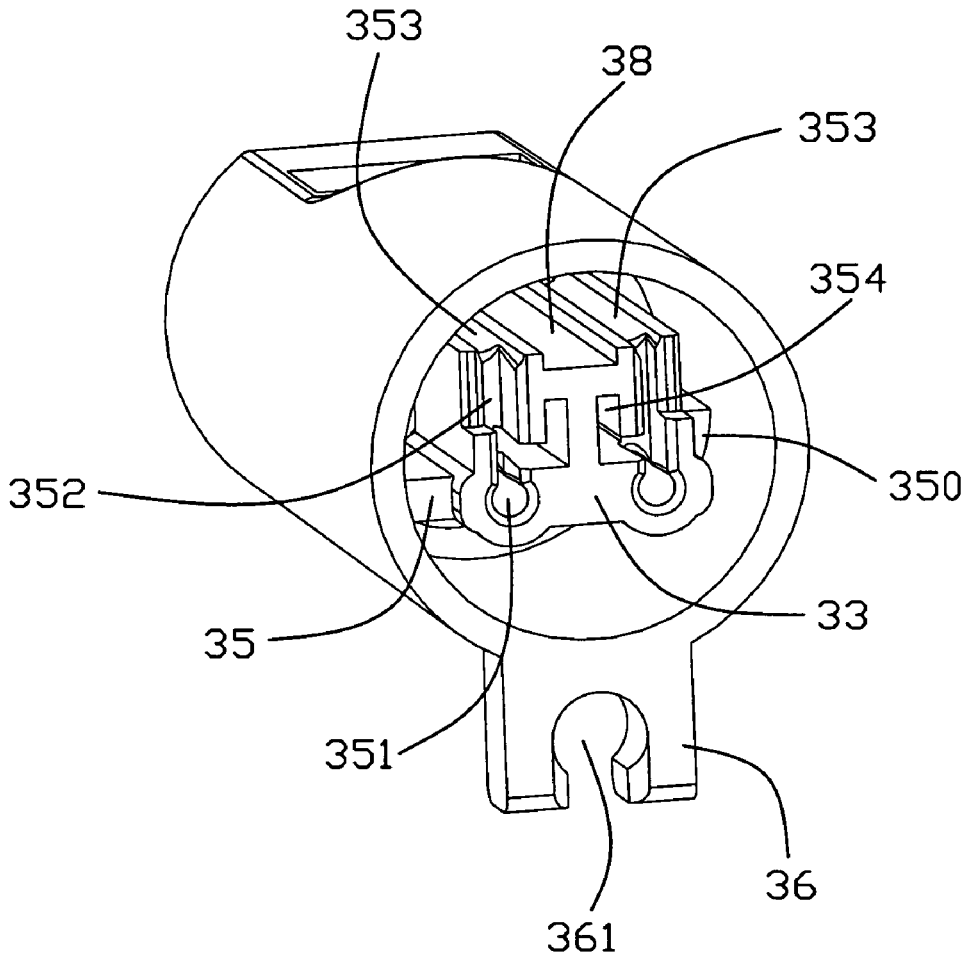
FIG. 3 is an enlarged view of a lamp base of the lamp assembly.
Figure 4:
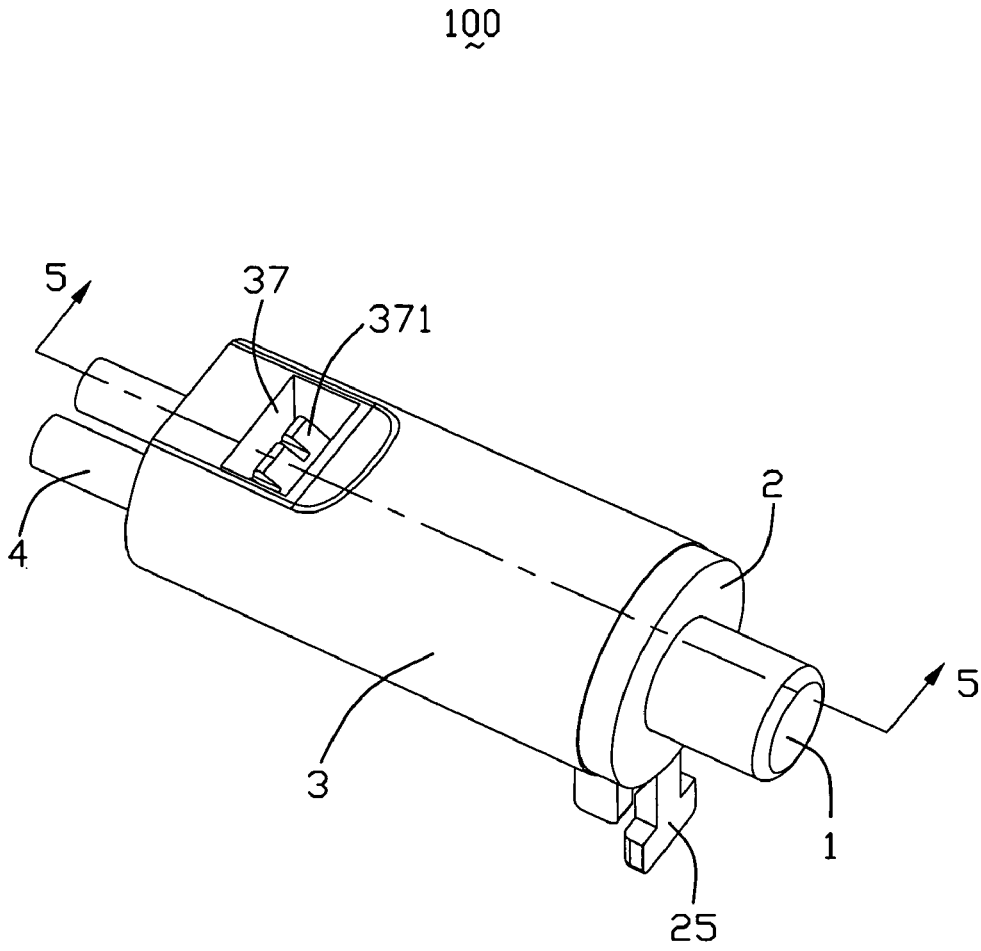
FIG. 4 is assembled, perspective view of the lamp assembly.
Figure 5:
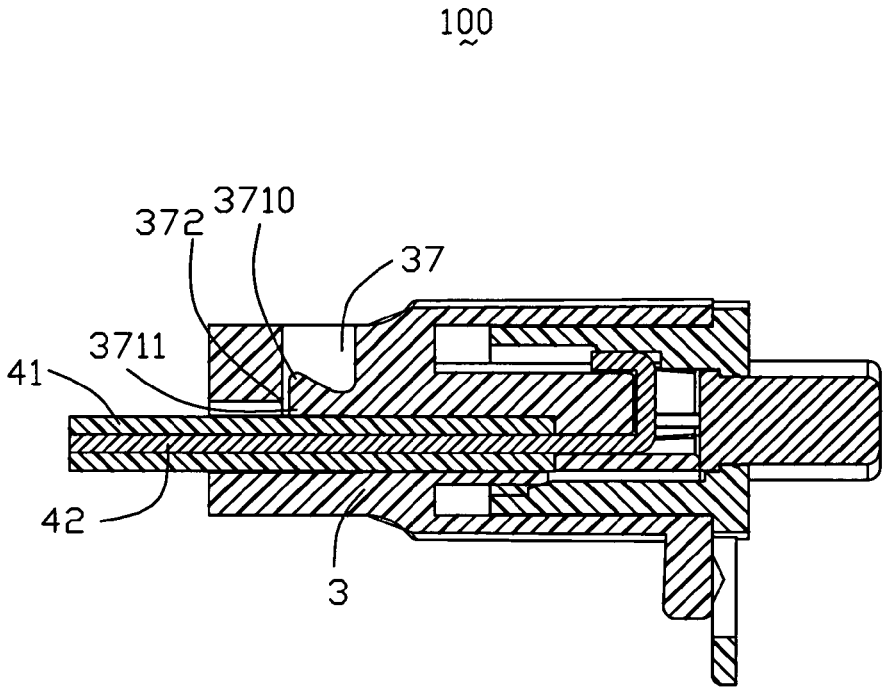
FIG. 5 is a cross-section view of FIG. 4 taken along line 5-5.
Figure 6:
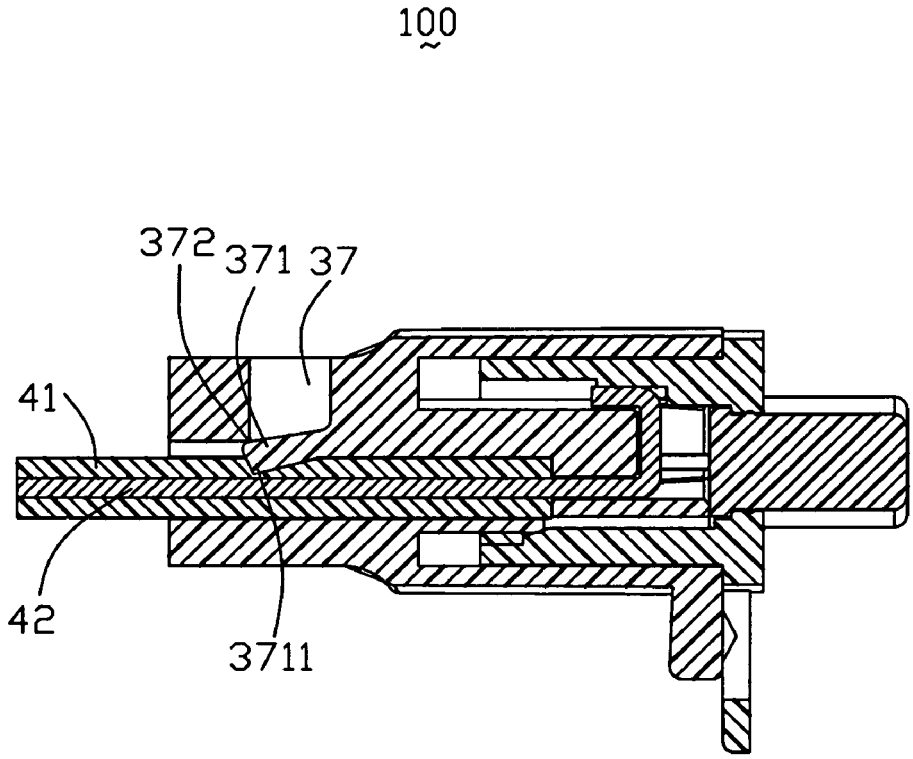
FIG. 6 is a view similar to FIG. 5, showing locking member clipping against cables.
Figure 7:
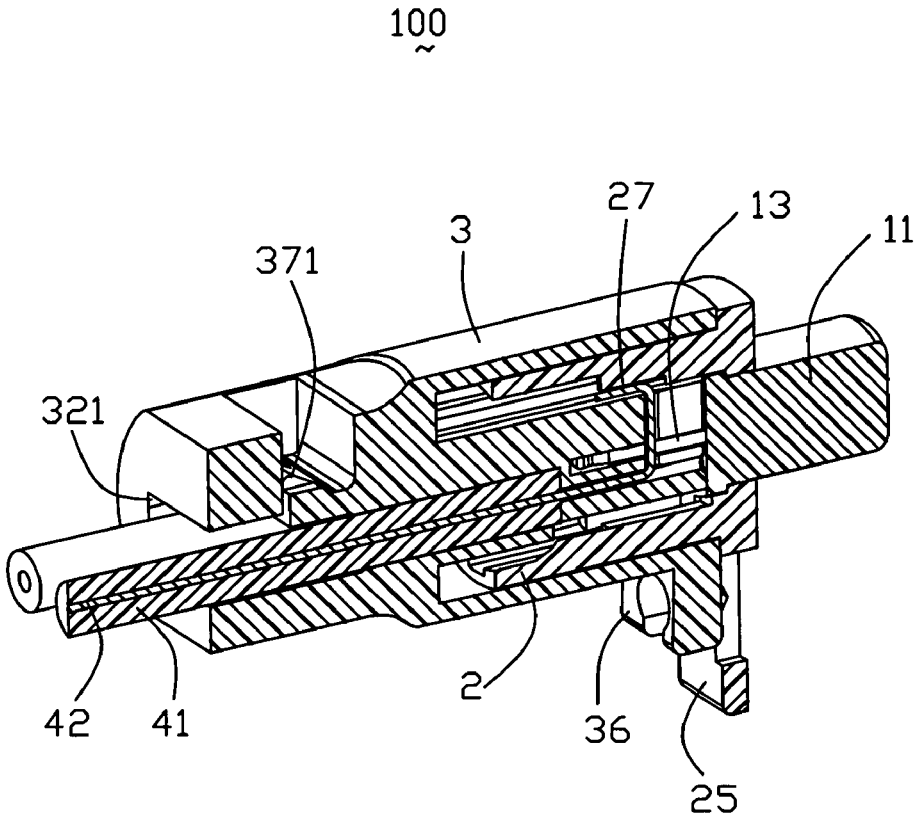
FIG. 7 is a cross-section view of FIG. 4 taken along line 5-5, but viewed from another direction.

Please particularly referring to FIG. 3, a mounting portion 33 is accommodated in the front of the sock 30 and disposed between the first and second posts 35, 350. The mounting portion 33 has two passageways 351 defined in lateral sides of a lower portion thereof and further communicate with the cable passage 321. A pair of first grooves 352 are recessed inwardly from a front surface of the lateral sides of an upper portion of the mounting portion 33 and orthogonal with the passageways 351. A pair of second grooves 353 are recessed downwardly from a top surface of the upper portion and substantially perpendicular and joining to the first grooves 352. A pair of slots 354 extend inwardly from a front face of a center section 38 of the mounting portion 33, and a lower portion of each slot 354 further communicates with corresponding first groove 352. An attached member 36 is arranged at a lateral portion of a front segment of the peripheral wall 31, with a Ω-shaped cavity 361 defined therein.

A cavity 37 is recessed downwardly from a top surface of a rear portion of the cylindrical peripheral wall 31. A locking member 371 is arranged in a lower section of the cavity 37 and further adjacent to the cable passage 321. The locking member 371 has a free end (not numbered) proximate to a corner 372 between the cable passage 321 and the cavity 37.

Each of the cables 4 has at least a conductor 42 and a jacket 41 shielding the conductors 42. Partial of the jacket 41 of a front section of the cable 4 is removed, with the conductor 42 exposed outside. The unshielded conductor 42 is configured to be hook-shaped, including a first horizontal segment 420 extending forwardly from an interior of the cable 4, a vertical segment 421 extending upwardly from a front end of the first horizontal segment 420 and a second horizontal segment 422 parallel to the first horizontal segment 420 and extending rearwardly from a top section of the vertical segment 421.

When assemble, the cables 4 are insert into the cable passage 321 of the lamp base 3 and the conductors 42 are bent to hook the mounting portion 33, with the first horizontal segments 420 received in the two passageways 351, the vertical segments 421 mounted to the first grooves 352 and the second horizontal segments 422 mounted to the second grooves 353. The locking member 371 is pressed inwardly, with a lower tip 3711 of the free end thereof pressing onto the jackets 41 of the cables 4, while an upper tip (not numbered) slides into the cable passage 321 and is inhibited by the corner 372 to prevent it retracting. Thus, the cables 4 are secured to the lamp base 3. Secondly, the lamp bulb 1 is assembled to the lamp base 3, with legs 13 inserted into the slots 354 of the mounting portion 33 and contacting the vertical segments 421 of the conducts 42 to form electrically connection therebetween. Thirdly, the lamp holder 2 is assembled to the lamp base 3, with the body portion 21 thereof inserted into the socket 30, the protruding portions 27 of the body portion 21 pressing onto the second horizontal segments 422 of the conductors 42. The ribs 22 of the peripheral portion of the body portion 21 may increase combination between the lamp holder 2 and the lamp base 3. Thus, the conductor 42 is reliably sandwiched between the lamp holder 2 and mounting portion 33. Fourthly, the clasp 25 latches with the attached member 36 to make the LED lamp 1, the lamp holder 2, the lamp base 3 coupled together more reliably.

The lamp base 3 can be coupled to the cables 4 by retention structure itself, without other auxiliary means, such as conductive pads. Therefore, the lamp assembly 100 may be manufactured easily and the cost is cut down.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A lamp assembly, comprising:

a lamp base defining a socket, with a mounting portion arranged therein and unitarily formed with the lamp base;

a pair of cables inserted into the socket via a cable passage defined in a rear portion of the lamp base, with conductors of the cables extending through passageways in the mounting portion and configured to hook thereon;

a lamp holder having a body portion inserted into the socket of the lamp base together with the mounting portion to sandwich the conductors; and a lamp bulb held by the lamp holder, with a pair of legs thereof inserted into the socket and contacting conductors of the cables.

2. The lamp assembly as recited in claim 1, wherein a pair of first grooves are recessed inwardly from a front surface of the mounting portion and join to the passageways, a pair of second grooves are recessed downwardly from a top surface of the mounting portion and joins to the first grooves, respectively.

3. The lamp assembly as recited in claim 2, wherein the conductors extending beyond the front surface of the mounting portion are mounted to the first and second grooves.

4. The lamp assembly as recited in claim 3, wherein a lamp holder together with the mounting portion sandwich the conductors disposed in the second grooves to prevent the cables sliding out of the lamp base.

5. The lamp assembly as recited in claim 4, wherein two protruding portions formed on an inner surface of the body portion of the lamp holder respectively press onto the conductors.

6. The lamp assembly as recited in claim 1, wherein a number of ribs are formed on a peripheral portion of the body portion of the lamp holder and extend along an axial direction.

7. The lamp assembly as recited in claim 1, wherein a pair of slots extend inwardly from a front face of a center section of the mounting portion, said pair of slots further communicating with the pair of first grooves, respectively.

8. The lamp assembly as recited in claim 7, wherein the pair of legs of the lamp bulb are inserted into the pair of slots of the mounting portion and contact the conductors disposed in the first grooves.

9. The lamp assembly as recited in claim 1, wherein the lamp holder further has a lid with a outlet to allow a partial of the lamp bulb through.

10. The lamp assembly as recited in claim 9, wherein a clasp is formed at a lateral portion of the lid of the lamp holder, wherein an attached member with a cavity is arranged at lateral portion to latch with the clasp.

11. The lamp assembly as recited in claim 10, wherein a post is arranged aside of mounting portion and connected to an inner surface of the lamp base, and the body portion of the lamp holder defines a lengthwise slot receiving the post.

12. A lamp assembly comprising:

a lamp base defining a lamp holder receiving cavity extending along an axial direction with a mounting portion in a middle portion of said lamp holder receiving cavity;

a pair of cables including a pair of partially exposed inner conductors mounted upon the mounting portion; and a lamp holder defining a first part cooperating with the mounting portion to retain a lamp bulb therebetween in said axial direction, and a second part received in the lamp holder receiving cavity and cooperating with the mounting portion to retain a first section of each corresponding conductor; wherein said lamp bulb includes a pair of contact legs each engaging a second section of each corresponding conductor; wherein the lamp holder is discrete and separate from the lamp bulb, and is configured to be assembled to the lamp base only after the lamp bulb is assembled to the lamp base, and further includes means for restricting outward movement of the lamp bulb in the axial direction to hold the lamp bulb to the lamp base.

13. The lamp assembly as claimed in claim 12, wherein said second part cooperates with said mounting portion to sandwich the first section of the corresponding conductor in a transverse direction perpendicular to said axial direction.

14. The lamp assembly as claimed in claim 13, wherein said contact leg engages the second section of the corresponding conductor in a second transverse direction perpendicular to both said first transverse direction and said axial direction.

15. The lamp assembly as claimed in claim 14, wherein said first section of the corresponding conductor extends in an axial direction while the second section of the corresponding conductor extends in the first transverse direction.

16. The lamp assembly as claimed in claim 15, wherein said conductor further includes a third section extending along the axial direction so as to cooperate with said first section and said second section to form a U-shaped configuration.

17. The lamp assembly as claimed in claim 12, wherein said mounting portion defines a groove receiving the second section of the conductor therein, and a slot communicating with the groove to receive the contact leg therein.

18. A lamp assembly comprising:

a lamp base defining a lamp holder receiving cavity with a mounting portion extending therein along an axial direction;

a pair of cables each including a partially exposed inner conductor mounted upon the mounting portion; and a lamp holder including a plate like first part cooperating with the mounting portion to sandwich a lamp bulb therebetween in the axial direction, and a tube like second part received in the lamp holder receiving cavity and cooperating with the mounting portion to sandwich the inner conductor in a transverse direction perpendicular to said axial direction; wherein the lamp bulb includes a pair of contact legs spaced from the second part of the lamp holder while engaging the corresponding inner conductors, respectively.

19. The lamp assembly as claimed in claim 18, wherein the tube like second part circumferentially encloses the mounting portion and the exposed inner conductor therein.

20. The lamp assembly as claimed in claim 18, wherein a front portion of the exposed inner conductor is reversely bent and sandwiched between the second part of the lamp holder and the mounting portion.

* * * * *